United States Patent [19]

Kittle

[11] 4,034,129

[45] July 5, 1977

[54] METHOD FOR FORMING AN INORGANIC THERMAL RADIATION CONTROL

[75] Inventor: Paul A. Kittle, Gardenville, Pa.

[73] Assignee: Rohm and Haas Company, Philadelphia, Pa.

[22] Filed: July 18, 1975

[21] Appl. No.: 597,117

[52] U.S. Cl. ..... 427/163; 428/469; 428/458; 428/461; 428/446; 428/500; 427/168; 427/86; 427/87; 427/93; 350/1; 350/164; 106/74; 106/288 R; 106/287 S

[51] Int. Cl.[2] ..... B05D 5/06

[58] Field of Search ..... 427/163, 168, 93; 428/446, 469, 458, 461, 538, 539, 500

[56] References Cited

UNITED STATES PATENTS

| | | | |
|---|---|---|---|
| 2,581,632 | 1/1952 | Colbert et al. | 428/446 X |
| 3,287,142 | 11/1966 | Russell, Jr. | 428/469 X |
| 3,442,721 | 5/1969 | McCaldin et al. | 428/469 X |
| 3,718,528 | 2/1973 | Bergstrom | 428/458 X |
| 3,775,226 | 11/1973 | Willdorr | 428/458 X |
| 3,901,997 | 8/1975 | Groth | 428/469 X |
| 3,914,469 | 10/1975 | Delano et al. | 428/446 X |

*Primary Examiner*—P. C. Ives

[57] ABSTRACT

A method is disclosed for forming a water-based inorganic coating capable of controlling thermal radiation which method comprises applying a layer of a semiconductor pigment upon a highly reflective substrate having a metallic layer and overcoating the pigment layer with a layer of an alkali metal silicate, and heat curing the silicate layer at above ambient temperature, where the two-layer laminate so obtained exhibits high absorbance of visible spectral radiation and low emissivity of thermal radiation.

3 Claims, No Drawings

METHOD FOR FORMING AN INORGANIC THERMAL RADIATION CONTROL

This invention relates to a method for forming inorganic coating useful for controlling thermal radiation when applied upon thermally reflective substrates.

Heretofore, various methods have been employed for producing a thermal radiation control surface upon thermally reflective substrates. Such surfaces have a number of uses, among which are solar collector absorber panels, space vehicle surfaces, military applications such as a camouflaging military vehicles from detection by infrared scanning and the like.

The most common methods for forming such surfaces are by electrochemical deposition techniques followed by chemical oxidation of the deposit and by "paint" technology using organic based coatings. In the former case, a suitable substrate, such as for example aluminum, is electroplated with a metal such as copper to yield a copper surface on an aluminum substrate. The copper surface is then chemically oxidized to yield a surface of cupric oxide on aluminum. The objection to this method is the high cost of a combined electrochemical/chemical oxidation process to obtain the desired surface.

"Paint" technology has been applied to this problem and some coatings have been developed using organic solvents and organic binders. Most noteworthy is a lead sulfide/silicone resin binder in xylene "paint" disclosed by Williams, Lappin and Duffie in their publication on "Selective Radiation Properties of Particulate Coatings" in the July 1963 issue of the Journal of Engineering for Power. The growing concern with organic based paints, from a safety, health and ecology viewpoint militates against organic solvent based coatings in the formation of thermal radiation control surfaces. Further, such organic "paints" do not possess optimally achievable radiation control properties.

Water-based "paints" using inorganic binders have also been investigated. A black silicate paint has been developed at the Goddard Space Flight Center and the results are embodied in National Technical Information Service publication N74-10545. This particular formulation essentially involves a suitable pigment bound in an alkali metal silicate such as for example sodium silicate. Such a formulation is sprayable upon a suitable substrate in order to achieve an effect similar to that obtainable by the electrochemical process or by organic binder paint technology. The most serious problem with this coating is that the suitable pigments react chemically with the silicate binders to give pigment silicate salts or complexes. These compounds alter the properties of absorbance and emissivity of the coating to such an extent that although homogenous silicate binder/pigment coatings are much less costly then the electrochemical/oxidation coatings and avoid the organic solvent problems of the organic "paints", they do not even perform as well as the latter, and are thus fairly useless.

The present invention, however, overcomes this problem by employing a two-layer laminate water-based coating method in which a layer of a semiconductor pigment is first deposited upon a thermally reflective substrate and this pigment layer is overcoated with an alkali metal silicate binder, where the silicate layer is heat cured at above ambient temperatures to form a protective coating over the pigment.

The technology of thermal radiation control surfaces is based on the need to obtain a surface which absorbs radiation in the range of 300 to 1000 nanometers while at the same time not allowing thermal energy to be radiated therefrom. This basic principle accounts for the operation of solar collector absorber panels, infrared transparent coatings used on military equipment and the like. The general approach is to start with a substrate material that has high reflective (low absorbtance) over the entire range spectral range (300 to 10,000 nanometers, for example). Examples of such useful substrates include metals such as aluminum, copper, steel and the like, and non-metallic substrates, such as plastics and glass which can be metallized to provide a highly reflective surface.

In order to obtain the desired properties of opaqueness to ultraviolet and visible light and transparency to infrared radiation, it is necessary to form a surface on the highly reflective substrate which absorbs in the visible and ultraviolet region while transmitting in the infrared. It is necessary to make the surface selective, i.e., as highly absorbing as possible in the visible range and as highly reflecting (low emitting) as possible in the thermal range. This requirement makes semiconductor pigments highly desirable, as these compounds are highly transparent in the infrared but absorbing in the visible. Not all semiconductor pigments are useful, as those having a high refractive index and thus a high surface reflection coefficient give rise to unacceptable reflection losses. Thus, only those semiconductor pigments having low enough refractive indices to keep surface reflectivity at a minimum are acceptable. Among such useful semiconductor pigments are copper oxide, iron oxides, both naturally-occurring and synthetically made, chromium oxides, nickel oxide, complexes of nickel-zinc-sufide, lead sulfide and so forth. Since thermal and photochemical stability is required of the semiconductor, organic dyes would not be very useful and the preferred semiconductors are, therefore, the inorganic pigments already enumerated.

A semiconductor pigment solution is prepared by dispersing a given pigment in water with the optional addition of a wetting agent to aid in dispersion. This solution is then deposited onto a suitable substrate by known means, such as spraying. Depending upon the pressure, pattern and mixture adjustments of the spraying equipment, three to about ten passes of the sprayer are sufficient to achieve a semiconductor pigment layer that exhibits desired absorbance and emissivity properties. The pigment-coated substrates may then be heat cured to give a rapid drying of the pigment layer. The temperature need be no higher than is necessary to drive off the water of the solution.

It will further be appreciated that when the pigment is composed of particles (as opposed to surfaces formed by electrochemical means which are essentially non-particulate) the layer formed therefrom will be mechanically weak unless a binder is used to hold the particles together and bound onto the substrate. It is this binder that presents the greatest difficulty. This binder must be stable against corrosion, degradation by sunlight and heat, and where vacuum conditions may exist, as for example in a solar collector, the binder must have essentially zero vapor pressure at the operating conditions. Lastly, the binder must be substantially non-emissive in order that it provide no interference to the operation of the pigment layer. In general, organic chemicals cannot be used successfully as binding agents, since they usually are not infrared transparent. For example, silicon resins have been used as binding agents, but such resins have absorption bands in those portions of the spectrum where the ideal binder must be transparent. These deep absorption bands result in high emittance, making these resins highly undesirable as binders. The number of low refractive index materials transparent to long-wave radiation capable of acting as binders for particulate coatings is very small. Quartz, although obviously unusable as a binding substance, is a classical example of material exhibiting a low refractive index and transparency to long-wave radiation. This has led, however, to the discovery that alkali metal silicates are suitable binders, exhibiting low emissivity, thermal stability, low refractive indices, durability and freedom from corrosion.

As has been indicated, however, if the pigment and alkali metal silicate are admixed, it is believed that a chemical reaction occurs, yielding silicates of the pigments which have higher indices of refraction than the alkali metal silicates. Such coatings exhibit high emissivity which is not appreciably offset by their absorbance, Thus, where ideal absorbance is 1.0 and ideal emissivity is 0 (practical ideal values being about 0.9 and 0.05–0.08, respectively), the homogenous pigment-in-binder coatings are such that their absorbance and emissivity values cannot be separated by more than about 0.3 (absorbance − emissivity = 0.3). Thus, such homogenous coatings are not very effective.

However, if an alkali metal silicate is coated over the pigment already deposited on the substrate, and heat cured, the problem encountered with the homogenous composition is avoided and the absorbance and emissivity values of the pigment layer remain almost unaffected. Thus, binding of the pigment is accomplished without affect on its thermal radiation control properties. The silicate layer is heat cured at above ambient temperatures and it is sufficient to heat just until water is driven off. Thus, curing at a temperature of about 150° C. for periods of time between 30 and 60 minutes is fully sufficient. However, due to the thermal stability of alkali metal silicates at temperatures exceeding 550° C., no upper limit on the useful range of heat curing temperatures can be fixed. It is to be noted that excessively rapid heating at high temperature will give rise to intumescence and bubbling of the silicate layer as opposed to a smooth layer obtained by gradual dehydration.

The useful alkali metal silicates include sodium orthosilicate, sesquisilicate, sesquisilicate pentahydrate, metasilicate, metasilicate pentahydrate, metasilicate hexahydrate, metasilicate octahydrate, metasilicate enneahydrate, disilicate, trisilicate, tetrasilicate, potassium metasilicate, metasilicate hemihydrate, metasilicate monohydrate, disilicate, disilicate monohydrate, tetrasilicate, tetrasilicate monohydrate, lithium metasilicate and orthosilicate. Organic quaternary ammonium silicates, such as tetraethanolammonium silicate are also useful as binding agents.

The silicates are preferably made into an aqueous solution with the optional use of a wetting agent. In general, solutions of 10 percent or less of silicate are preferred, as the viscosity of solutions increases as the quantity of silicate employed is increased. This increased viscosity creates problems when the solutions are to be sprayed over the pigment layer.

The use of silicates as a binding overcoat will give rise to some pigment-silicate reaction as in the case of homogenous silicate "paints", however, the increase in emissivity occasioned by this pigment-silicate interface reaction is almost inconsequential, being on the order of about 0.04–0.05. Thus, the high absorbance and low emissivity properties of the semiconductor pigment are only insignificantly altered by the binder layer, whereas homogenous one coat silicate paints radically alter the absorbance-emissivity properties of the semiconductor pigments bound up therein.

The following examples are illustrative of the above-presented facts relative to both homogenous silicate "paints" and the two-layer laminate coating method of the present invention.

EXAMPLE I

A homogenous coating is prepared in the following manner:

A. Sand-grind paint concentrate:

200 gms. black iron oxide (BK247, EK Williams Co.)
30 gms. sodium silicate solution (40°-42° Be, 38.4 percent solids).
325 gms. water
100 gms. sand, 30 mesh This mixture is stirred for 30 minutes at 3450 rpm and is then filtered to remove the sand. 4 gms of octylphenoxypolyethoxyethanol (wetting agent) and 1664 gms. of water are added to make a composition that is:

9.01% black iron oxide
1.35% sodium silicate solution
0.18% octylphenoxypolyethoxyethanol
89.46% water This mixture is then adjusted to the following concentration 2.0 black iron oxide
1.4% sodium silicate solution
0.3% octylphenoxypolyethoxyethanol
96.3% water This "paint" is applied in multiple spray passes to 4 × 4 aluminum sheet using a spray gun set at a pressure of 60 p.s.i.g. using compressd nitrogen. The sprayed sheets are cured at 150° C. for 30 minutes. Emissivity values ($e$) are determined at 150° C. using an infrared thermometer. Absorbance values ($a$) are calculated using the recording spectrophotometer refractance spectra. The results are given in Table I.

TABLE I

| SPRAY PASSES | EMISSIVITY[1] | ABSORBANCE | EMISSIVITY[2] |
|---|---|---|---|
| 10 | 0.35 | 0.64 | 0.25 |
| 12 | 0.39 | 0.64 | 0.30 |
| 14 | 0.39 | 0.67 | 0.32 |

[1]After heating at 150° C. for 30 minutes
[2]Measured after 30 minutes heating at 325° C.

The results show that the homogeneous coating composition exhibits high emissivity relative to practical emissivities of about 0.2 or less, and low absorbance relative to practical absorbances of about 0.9.

EXAMPLE II

The homogenous paint of Example I is reformulated, this time however, using cupric oxide, chromium oxide and red, black and brown iron oxide pigments. A four spray pass sample using black iron oxide pigment yields values of 0.31 for emissivity and 0.58 for absorbance. The other pigments in comparable situations give results which vary greatly but always maintain a 0.25–0.35 difference between absorbance and emissivity. Thus, for example, a sample giving absorbance of 0.95 has an emissivity value of 0.6. Another sample gives an emissivity value of 0.15, but an absorbance of 0.50.

EXAMPLE III

A sodium silicate solution is prepared as follows:

| | |
|---|---|
| Sodium silicate solution (38.4% solids) | 2.0% |
| Octylphenoxypolyethoxyethanol | 0.3% |
| Water | 97.7% |

This solution is applied in multiple spray passes onto 4 × 4 aluminum plates with a spray gun. The emissivity of each sample is measured after 30 minutes cure at 150° C. and again after 30 minutes cure at 325° C. The results are summarized in Table II.

TABLE II

| SPRAY PASSES | EMISSIVITY 150° C. | EMISSIVITY 325° C. |
|---|---|---|
| 5 | 0.09 | 0.11 |
| 10 | 0.12 | 0.12 |
| 15 | 0.16 | 0.14 |
| 20 | 0.21 | 0.16 |

It is obvious that sodium silicate is a low emissive compound ideally suited as an overcoating binder for semiconductor pigments.

EXAMPLE IV

A semiconductor pigment mixture is prepared as follows:

| | |
|---|---|
| Black iron oxide (Pfizer BK4799) | 5.00% |
| Octylphenoxypolyethoxyethanol | 0.15% |
| Water | 94.85% |

This mixture is applied in 10 spray passes onto 4 × 4 aluminum plates with a spray gun using 35 p.s.i.g. of nitrogen. The coating so obtained is heated to 365° C. for 30 minutes. The emissivity value is measured at 0.16 while the absorbance at about 0.87. Red iron oxide is substituted for black iron oxide in the pigment mixture, and the mixture is sprayed onto test panels in multiple passes, cured at 175° C. and emissivity is measured at 150° C. The results are given in Table III.

TABLE III

| SPRAY PASSES | EMISSIVITY |
|---|---|
| 3 | 0.13 |

TABLE III-continued

| SPRAY PASSES | EMISSIVITY |
|---|---|
| 4 | 0.14 |
| 5 | 0.15 |

The samples show the low emissivity properties exhibited by semiconductor pigments such as the iron oxides.

EXAMPLE V

A solution of 1.0% sodium silicate solution (38.4% solids), 0.05% octylphenoxypolyethoxyethanol and 98.85% water is prepared. This solution is sprayed onto the test panels prepared in Example IV using a spray gun set at 35 p.s.i.g. nitrogen. Three air dried passes are followed by a 30 minute drying period at 150° C. The postcoated black iron oxide sample now gives an emissivity of 0.20 (an increase of 0.04 over that of the uncoated sample) and the absorbance is now 0.77.

The 4 and 5 pass red oxide samples are similarly postcoated and the emissivity and absorbance results are, respectively: 0.19, 0.19; 0.75, 0.77.

A black iron oxide sample, prepared according to Example IV, but with 12 passes, is postcoated in the manner of the samples in this example with three spray passes. The original emissivity value is 0.18. After postcoating the emissivity increases to 0.28 but the absorbance is measured at 0.85.

This example clearly shows that the two-layer laminate method provides a radiation control surface which preserves almost unaltered the low emissivity high absorbance values of the semiconductor pigments used.

I claim:

1. A method for producing a two-layer laminate water-based thermal radiation control coating upon a metallic or metallized substrate which comprises depositing upon the substrate a layer of a semiconductor pigment solution, drying said pigment layer, overcoating the pigment layer with a layer of an alkali metal silicate solution and heat-curing the silicate layer at above ambient temperature.

2. The method of claim 1, where the semiconductor pigment is a compound selected from copper oxide, iron oxides, chromium oxides, nickel oxide, nickel-zinc sulfide and lead sulfide.

3. A method for producing a thermal radiation control coating upon an aluminum substrate which comprises, depositing upon the aluminum a layer of an iron oxide aqueous solution, drying said iron oxide layer, overcoating the iron oxide layer with a layer of sodium silicate aqueous solution and heat-curing the silicate at above ambient temperature.

* * * * *